US008385580B2

(12) United States Patent
Adamson

(10) Patent No.: US 8,385,580 B2
(45) Date of Patent: Feb. 26, 2013

(54) HIGH POWER LOW FREQUENCY TRANSDUCERS AND METHOD OF ASSEMBLY

(75) Inventor: Alan Brock Adamson, Uxbridge (CA)

(73) Assignee: Adamson Systems Engineering Inc., Port Perry, ON (CA)

( * ) Notice: Subject to any disclaimer, the term of this patent is extended or adjusted under 35 U.S.C. 154(b) by 1525 days.

(21) Appl. No.: 11/847,480

(22) Filed: Aug. 30, 2007

(65) Prior Publication Data

US 2008/0056527 A1 Mar. 6, 2008

Related U.S. Application Data

(60) Provisional application No. 60/841,218, filed on Aug. 31, 2006.

(51) Int. Cl.
*H04R 1/00* (2006.01)
*H04R 9/06* (2006.01)
*H04R 11/02* (2006.01)

(52) U.S. Cl. ..... 381/401; 381/403; 381/405; 381/420; 381/421; 381/422

(58) Field of Classification Search ..... 381/397, 381/398, 400, 401, 403, 409, 405, 418, 420–422, 381/433
See application file for complete search history.

(56) References Cited

U.S. PATENT DOCUMENTS

| | | | | |
|---|---|---|---|---|
| 3,112,375 | A | 11/1963 | Ivan | |
| 4,291,781 | A | 9/1981 | Niguchi et al. | |
| 5,042,072 | A * | 8/1991 | Button | 381/397 |
| 5,335,287 | A * | 8/1994 | Athanas | 381/415 |
| 5,371,806 | A | 12/1994 | Kohara et al. | |
| 5,455,396 | A | 10/1995 | Willard et al. | |
| 5,608,810 | A | 3/1997 | Hall | |
| 5,715,324 | A | 2/1998 | Tanabe et al. | |
| 5,740,265 | A | 4/1998 | Shirakawa | |
| 5,748,760 | A * | 5/1998 | Button | 381/412 |
| 5,828,767 | A | 10/1998 | Button | |
| 5,897,486 | A | 4/1999 | Ball et al. | |
| 5,909,499 | A | 6/1999 | Tanabe | |
| 5,998,309 | A | 12/1999 | Hesler | |
| 6,219,432 | B1 * | 4/2001 | Fryer et al. | 381/398 |
| 6,237,716 | B1 | 5/2001 | Peng | |
| 6,305,491 | B2 | 10/2001 | Iwasa et al. | |
| 6,475,134 | B1 | 11/2002 | Ball et al. | |
| 6,591,938 | B2 | 7/2003 | Inoue et al. | |
| 6,639,994 | B1 | 10/2003 | Proni et al. | |
| 6,735,322 | B1 * | 5/2004 | Watanabe | 381/401 |
| 6,768,806 | B1 | 7/2004 | Button et al. | |
| 6,774,510 | B1 | 8/2004 | Moro et al. | |

(Continued)

FOREIGN PATENT DOCUMENTS

EP 0492142 B1 11/1991

OTHER PUBLICATIONS

Douglas J. Button; Magnetic Circuit Design Methodologies for Dual-Coil Transducers, Jd. Audio Eng., vol. 50, No. 6, Jun. 2002, pp. 427-441.

*Primary Examiner* — Charles Garber
*Assistant Examiner* — Calvin Choi
(74) *Attorney, Agent, or Firm* — Hill & Schumacher; Lynn C. Schumacher

(57) ABSTRACT

An acoustic transducer including a sound producing cone that is activated by a voice coil cylinder having a pair of spaced electrical windings that are retained in spaced relationship from a surround ferromagnetic ring that is carried by a heat sink and wherein a magnetic subassembly is mounted within the voice coil cylinder. The voice coil cylinder is supported by a pair of spaced suspension members or spiders and by the sound producing cone.

23 Claims, 9 Drawing Sheets

U.S. PATENT DOCUMENTS

| | | | |
|---|---|---|---|
| 6,847,726 | B2 | 1/2005 | Button et al. |
| 6,889,796 | B2 | 5/2005 | Pocock et al. |
| 7,012,345 | B2 | 3/2006 | Moro et al. |
| 7,024,014 | B1 | 4/2006 | Noll |
| 7,039,213 | B2 | 5/2006 | Hyre et al. |
| 7,057,314 | B2 | 6/2006 | Moro |
| 2003/0190052 | A1 | 10/2003 | Button et al. |
| 2004/0008859 | A1* | 1/2004 | Zhao ..... 381/401 |
| 2004/0105565 | A1 | 6/2004 | Butters et al. |
| 2005/0179326 | A1* | 8/2005 | Moro ..... 310/12 |
| 2006/0188120 | A1 | 8/2006 | Fisher |

* cited by examiner

HIGH POWER LOW FREQUENCY TRANSDUCERS AND METHOD OF ASSEMBLY

BACKGROUND OF THE INVENTION

1. Field of the Invention

The present invention is directed to lightweight but extremely high power low frequency transducers that are capable of operating at continuous power levels in a range of 3000 watts. To permit operation at such high power levels, the transducers of the invention are provided with an advanced heat sink construction and an air ventilating system that maximizes heat dissipation from the voice coils of the transducers.

2. Brief Description of the Related Art

A primary problem with large low frequency audio speakers or transducers is that as power is increased, there is an accompanying increase in the build up of heat in the voice coil. A large portion of the input power into a speaker or transducer is converted into heat within the coil. As electrical energy is supplied to the coil, the coil temperature rises. With the increase in coil temperature there is an increase in DC resistance within the coil which results in a loss of operating power. This heating is referred to as power compression, wherein a portion of the input power is effectively being turned into heat energy rather than sound energy. Not only can the long term power handling of the transducer suffer, but there is a mechanical limitation as well. The adhesives used to assemble the voice coil and coil cylinder will reach a melting point and the coil will eventually break apart and the system will fail.

In order to move a lot of air in an audio speaker or transducer, it is necessary to increase the size, that is the diameter, of the driver or speaker cone and/or increase the excursion or movement of the cone. However, with large drivers, as the diameter of the cone increases the cone becomes heavier and less rigid, thereby decreasing the efficiency and the transient response. Also, the larger the cone, the more power that is needed to move it and the greater the heat energy that is developed. Further, any perturbation in the geometry of a cone as it is forced through the air by the coil results is distortion and lowers the power handling capability of the driver. For these reasons, the diameter of most drivers has been conventionally limited to 18 inches or less, especially for paper cones. At larger sizes, a difference of one inch in diameter makes a significant difference in the mass necessary to maintain the required stiffness in a cone.

An additional problem for the larger drivers that have a greater throw or movement is that as the cone moves through its excursion, it often encounters uneven forces caused by a shape of the transducer box or housing or a room wherein the box or housing is placed. The cone then transfers the non axis-symmetric energy to the coil causing it to shift in a surrounding air gap, a phenomenon known as "cone rocking". To overcome this, most systems are developed with wider air gaps. Although this increase in tolerance of the air gap permits some "cone rocking" without adversely effecting the sound output, the wider gap not only requires more powerful magnets to maintain flux density across the additional gap space, but also results in a greater volume of air which functions as an insulator in the gap. Thus, the greater the air gap, the greater the build up of heat within the transducer with a resulting loss of operating power.

In an average conventional driver, the piston, which is the coil and the cone, is supported in two places, normally at a surround and at a spider. These two elements maintain the coil centered in the air gap and are generally sufficient axial support for drivers with short throw excursions and the "cone rocking" is usually not a problem, however, the larger drivers with greater excursions, greater support is necessary.

SUMMARY OF THE INVENTION

The present invention is directed to a high power low frequency acoustic transducer that operates as a subwoofer at a resonant frequency in a range of 35 Hz and is of a size of up to twenty one inches in diameter. The transducer includes a casting assembly including a basket casting having an inner hub, a heat sink casting having an inner hub and a pedestal casting wherein the heat sink casting is secured between the basket casting and the pedestal casting. A ferromagnetic ring is carried by the casting assembly and a voice coil cylinder is mounted centrally of the ring and spaced from said ring so as to define an air gap between first and second conductive windings that are spaced from one another and that are carried by said voice coil cylinder. The voice coil cylinder is suspended within the air gap by a first suspension member that supports an inner end portion of the voice coil cylinder to the casting assembly and a second suspension member that supports an outer end portion of the voice coil cylinder to the casting assembly such that the voice coil is movable in an oscillating manner relative to a central axis defined by the ring. A magnetic subassembly is provided that includes a magnet positioned between an inner ferromagnetic pole plate and an outer ferromagnetic pole plate. The magnetic subassembly is supported by the casting assembly so as to be concentrically positioned within the voice coil cylinder whereby a magnetic field is created through the voice coil cylinder and between the inner and outer ferromagnetic pole plates and the ferromagnetic ring. The invention further includes a sound producing cone positioned within the basket casting and having an inner portion connected to the outer end portion of the voice coil cylinder and an outer portion connected to the basket casting, whereby when an electric current is applied to the conducting windings, the voice coil cylinder moves in a oscillating motion within the air gap thereby vibrating the cone to produce sound.

According to the present invention, an acoustic transducer is provided which comprises:

a permanent magnetic subassembly supported by a first non ferrous frame structure, a ferromagnetic cylinder seated within and affixed to a second non ferrous frame structure, the second non ferrous frame structure being configured for heat dissipation such that the ferromagnetic cylinder and the second non ferrous frame structure are in a thermally conducting heat dissipation relationship, the second non ferrous frame structure in turn affixed to the first non ferrous frame structure to provide an annular gap between the ferromagnetic cylinder and the permanent magnetic subassembly;

a voice coil cylinder carrying two conductive windings spaced adjacent opposite ends of the voice coil cylinder, the voice coil cylinder supported within the annular gap by a first suspension member attached to one of said opposite ends which is also attached to the first non ferrous frame structure and a second suspension member attached to the other of said opposite ends which is also attached to a non ferrous frame structure other than the first non ferrous frame structure so that said voice coil cylinder encases all permanent magnetic material of the acoustic transducer; and a mechanically supported sound producing cone connected to the voice coil cylinder.

In the preferred embodiment, the magnet of the acoustic transducer is a permanent magnet formed of a neodymium material and the castings are formed of non ferrous materials. Also, in a preferred embodiment, the magnet subassembly is designed to seat on a raised support hub of the pedestal casting and includes a central opening through which an alignment cylinder of the pedestal casting extends so as to restrain the magnetic subassembly in seated position. In some embodiments the permanent magnet may be enclosed by an aluminum or other material casing. Also, the pedestal may include a circular recess that surrounds the support hub for purposes of positioning the first suspension member.

In preferred embodiments, the heat sink casting includes a bottom ring portion and a plurality of heat exchange fins that extend radially outwardly of the inner hub and a plurality of openings through the bottom ring for promoting air circulation relative to the fins. Also the ferromagnetic ring is secured to the inner hub of the heat sink casting such that heat from the ferromagnetic ring is conducted to the heat sink casting.

The basket casting of the acoustic transducer includes a plurality of arcuate arms that extend outwardly from the inner hub to an outer annular lip and a third suspension member is provided for connecting an outer portion of the sound producing cone to the annular lip. The outer edge portion of the sound producing cone is preferably reinforced and includes an upper convex surface leading to a free edge. The outer surface of the sound producing cone is also preferably generally slightly concave intermediate the outer portion and the inner portion thereof.

The invention is also directed to a method of assembling an acoustic transducer that includes a casting assembly that includes a basket casting having an inner hub, a heat sink casting having an inner hub and a pedestal casting having a central support hub, a ferromagnetic ring, a voice coil cylinder including first and second conductive windings that are spaced from one another, a first suspension member for supporting an inner end portion of the voice coil cylinder to the casting assembly and a second suspension member for supporting an outer end portion of the voice coil cylinder to the casting assembly, a magnetic subassembly including a magnet positioned between an inner ferromagnetic pole plate and an outer ferromagnetic pole plate, and a sound producing cone. The method includes placing the ferromagnetic ring within the hub of the heat sink and securing the ring in place and mounting the magnetic subassembly to the pedestal casting by placing one pole plate against the support hub thereof and securing the first suspension member to the inner end portion of said voice coil cylinder. Thereafter, the voice coil cylinder is placed in surrounding relationship with respect to the magnetic subassembly and retained in place in a fixed predetermined spacing relative to the magnetic subassembly and the first suspension member is secured to the pedestal casting.

Subsequently, the pedestal casting is placed on a platform of a heavy duty press so that the pedestal casting can not move and the heat sink casting with the ferromagnetic ring is placed on a press arm that is aligned with the pedestal casting. The press arm is used to force the heat sink casting into surrounding relationship to the voice coil cylinder so as to form an air gap there between and thereafter the heat sink casting is secured to the pedestal casting. The basket casting is then secured relative to the heat sink and pedestal castings and thereafter the second suspension member is secured to an outer portion of the voice coil cylinder and a surrounding portion of the basket casting. Subsequently, an outer portion of the sound producing cone is secured to the basket casting and an inner end of the sound producing cone is secured to the outer portion of the voice coil cylinder such that the sound producing cone will vibrate as the voice coil cylinder is oscillated when electric power is applied to the spaced windings on the voice coil cylinder.

An object of the present invention is to create large diameter subwoofer drivers that ideally operate at a resonant frequency in a range of 35 Hz and that can be of sizes larger that conventional speakers, up to 21 inches, and having excursion travel of as much as 26 mm from end to end. The transducers are designed to include voice cylinders that are laterally confined within narrow air gaps without interference with a closely spaced and surrounding ferromagnetic ring that is supported by a heat sink in order maximize heat dissipation from the coil area during use.

BRIEF DESCRIPTION OF THE DRAWINGS

A better understanding of the invention will be had with reference to the accompanying drawings wherein.

DESCRIPTION OF THE BACKGROUND AND OF THE INVENTION

The present invention is directed to creating large diameter subwoofer drivers that ideally operate at a resonant frequency in a range of 35 Hz and can be of sizes up to 21 inches having excursion travel of as much as 26 mm from end to end. The transducers are designed to include voice cylinders that are laterally confined within narrow air gaps in order maximize heat dissipation from the coil during use. The transducer assemblies includes a dual voice coils, frame castings, outer rings, front and rear spiders, surround suspensions and unique cones.

Figure 1:
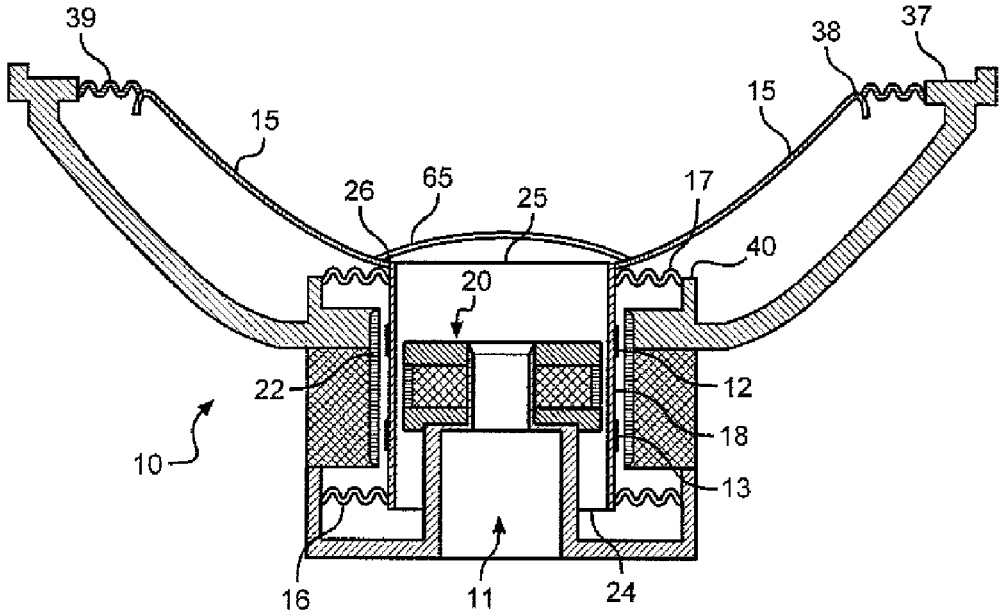
FIG. 1 is a cross section of a transducer in accordance with the invention.
Figure 2:
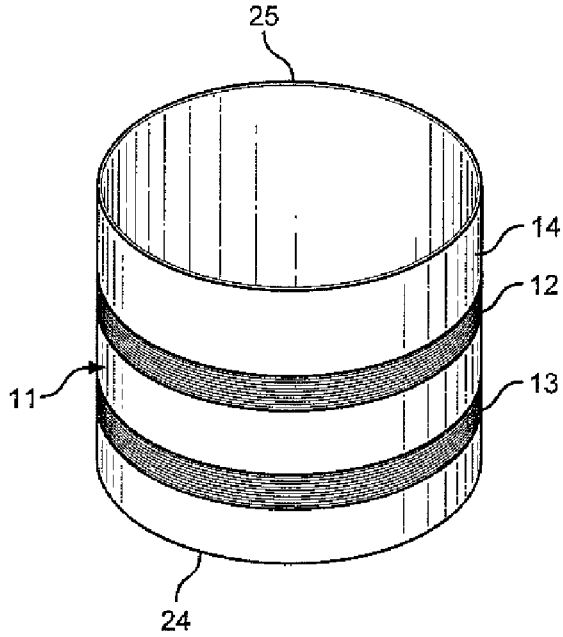
FIG. 2 is a perspective view of a dual winding voice coil of the invention.

With reference to the accompanying drawings and especially FIG. 1, the transducer 10 includes a dual coil, voice coil 11 having two conductive windings 12 and 13 wound in series onto a non-conductive voice coil cylinder 14. As shown, the conductive windings are spaced from one another. The voice cylinder mechanically connects to a speaker cone 15, an inner spider suspension member 16 and an outer spider suspension member 17 and is positioned to define an air gap 18 between a permanent magnet sub assembly 20 and an outer ring 22 so as to be perpendicularly oriented relative to a magnet circuit created within the transducer. The spacing of the coil windings is shown in FIG. 2.

As with conventional transducers, the transducer of the present invention is driven by an electromagnetic/mechanical system. An electronic signal is produced, generally by an amplifier, to feed a current into the voice coil. With a combination of the electrical current in the coil and the magnetic field created in the air gap, the coil oscillates axially in accordance with the power being supplied to it. The cone is stimulated by the axial movement of the coil and vibrates to thereby create sound. Because the transducer is designed to operate at power levels as previously noted, a controlled motion of the coil within a minimum air gap and an effective heat sink are required.

A key benefit of a dual coil motor is the increased efficiency and power handling for a given moving mass. This is because the electro dynamic force is doubled with the same amount of current in the coil. The increase in coil surface area also allows the coil to handle more current and the wattage per square centimeter is also divided in half. As a result of the lower wattage, less heat is generated per square centimeter along the coil. By separating the two coil windings, heat is dissipated more quickly into spaced sections of the motor assembly and, because of the increase in total surface area of the windings, heat is also more quickly dissipated into the surrounding air.

With conventional dual coil transducer systems, a single spider is normally used to attach to the outer portion of the voice coil. Because dual coils generally have longer voice cylinders, with a single spider used to attach the coil at its upper end, there is a tendency that the coil will rock or pivot within the air gap resulting in the voice coil either touching the magnet sub assembly on the inside or touching the outer ring, in either case the transducer will fail as previously described. Because of this, the air gaps were increased. However, in accordance with the present invention, it is important to maintain the clearance space within the air gap as small as possible in order to allow the ferromagnetic and non-ferrous materials to absorb heat and conduct the heat from the coil and surrounding air.

To control the motion of the voice coil within a tight air gap, of for example approximately 0.070 inch, the present invention supports the coil or piston at three spaced areas, as shown in FIG. 1. The first or inner spider suspension member 16 supports the inner end 24 of the coil cylinder 14, the second or outer spider suspension member 17 supports the coil cylinder adjacent an outer end 25 thereof and an inner edge 26 of the cone 15 is secured to the outer end of the coil cylinder. This support of the voice coil not only permits a smaller air gap 18 to be established, but it also permits better thermal performance by allowing heat to be dissipated more efficiently, as set forth above. Further, the support prevents accidental coil rubbing against the motor walls defining the air gap and thus prevents transducer failure.

Figure 3:
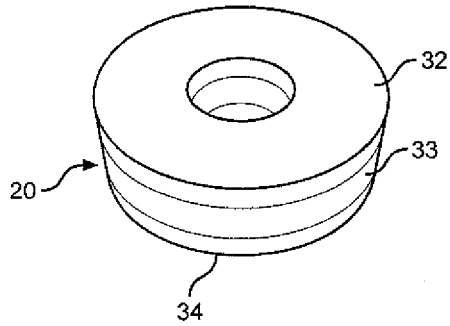
FIG. 3 is a perspective view of a magnetic sub assembly in accordance with the invention.
Figure 7:
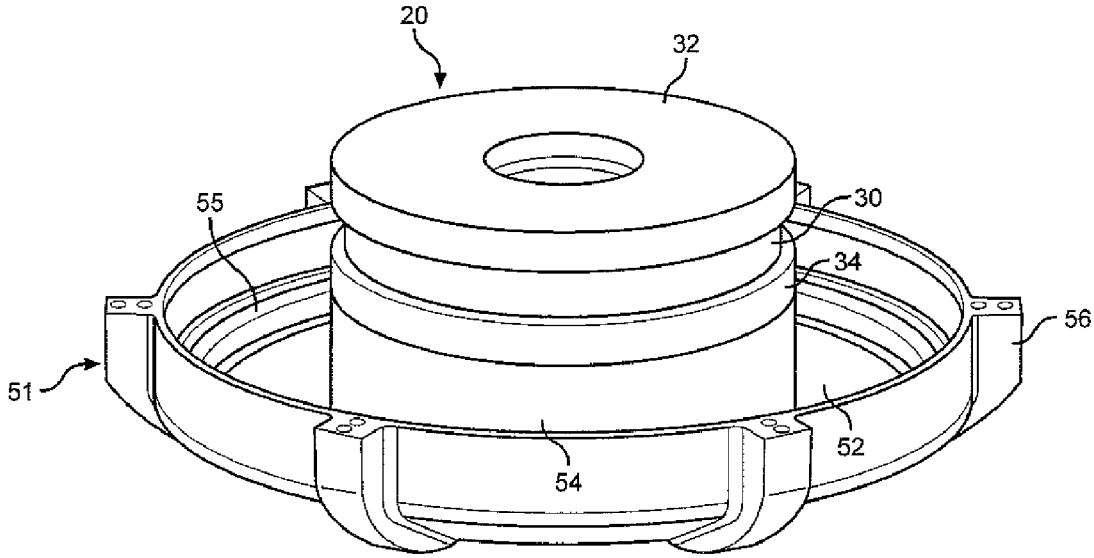
FIG. 7 is a view showing the assembly of the transducer magnetic sub assembly to the pedestal casting.
Figure 15:
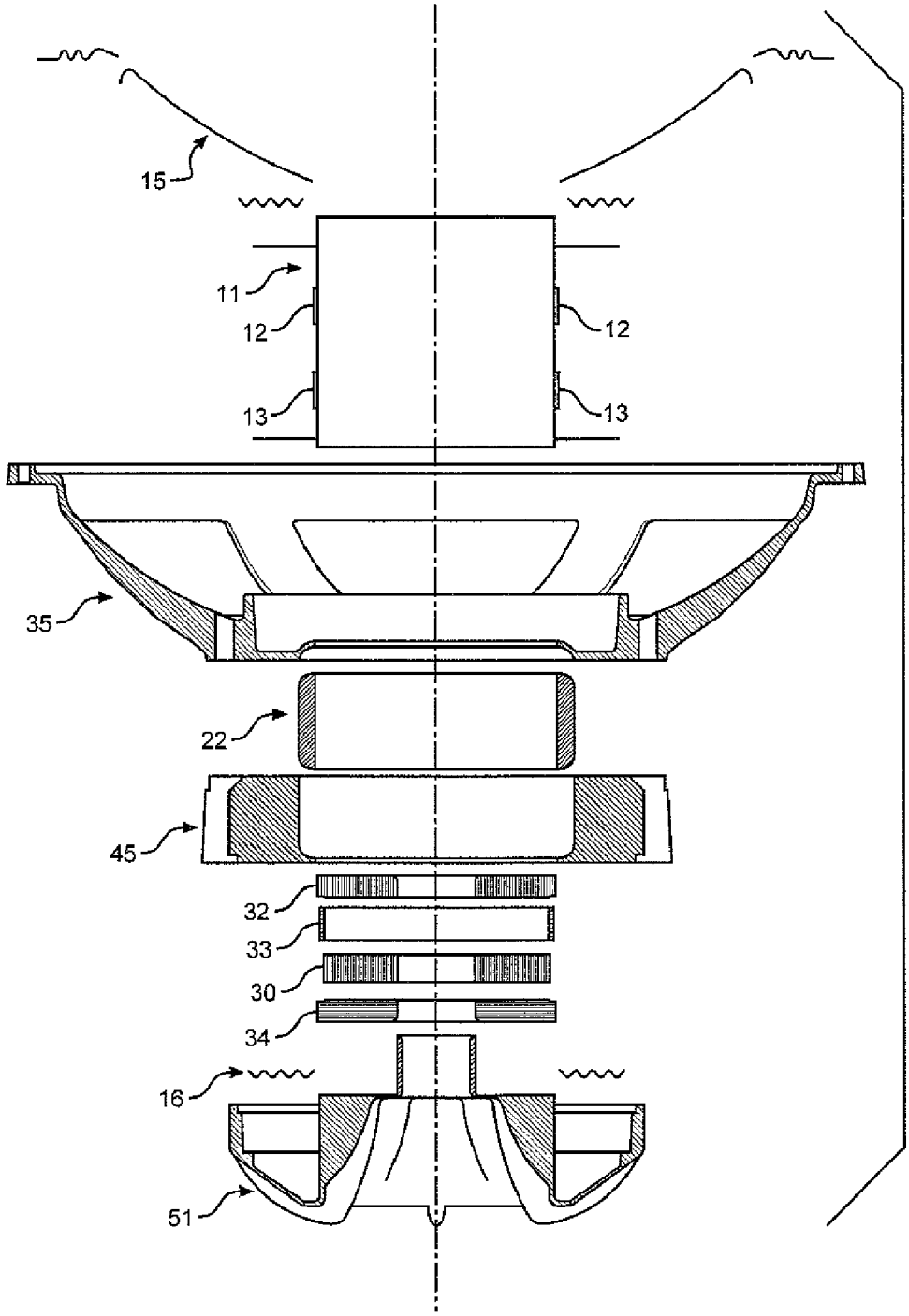
FIG. 15 is an assembly view of a transducer of the invention.
Figure 16:
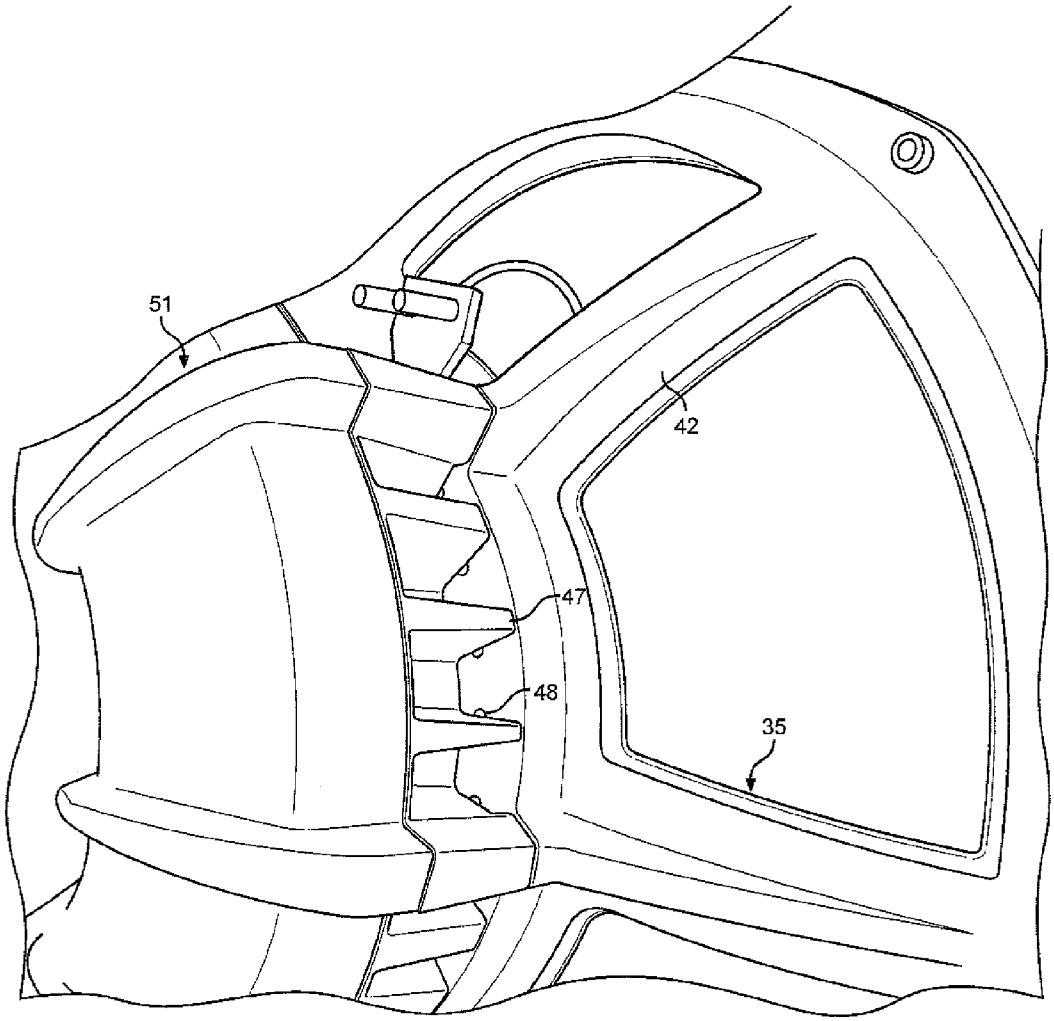
FIG. 16 is a rear perspective view of a transducer made in accordance with the teachings of the invention.

With reference to FIG. 3 and FIG. 7, the loudspeakers of the present invention are generally cylindrically symmetrical and use a permanent magnet together with ferromagnetic materials to create a magnetic circuit that steers a magnetic flux into the air gap. The magnetic circuit is defined by the annular outer ring 22 that is spaced around the magnetic sub assembly 20 by the width of the air gap. The magnetic sub assembly includes a lightweight neodymium magnet 30 positioned between a front ferromagnetic pole plate 32 and a rear ferromagnetic pole plate 34. A circular aluminum casing 33 encircles the magnet 30, see the assembly view of FIG. 15. In effect, the magnetic sub assembly is a magnetic sandwich that is magnetized so that the front pole plate is north and the rear pole plate is south. The neodymium material is necessary as it exhibits greater power per unit of mass. As the transducers of the present invention are so large, ferrite magnets could not be used as they would be too large and heavy.

Figure 4:
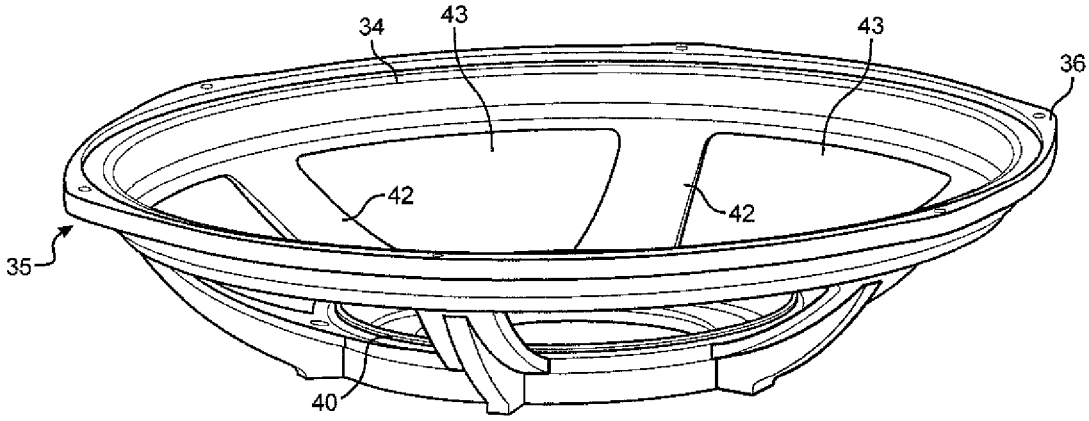
FIG. 4 is a perspective view of a frame or basket casting of the invention.
Figure 5:
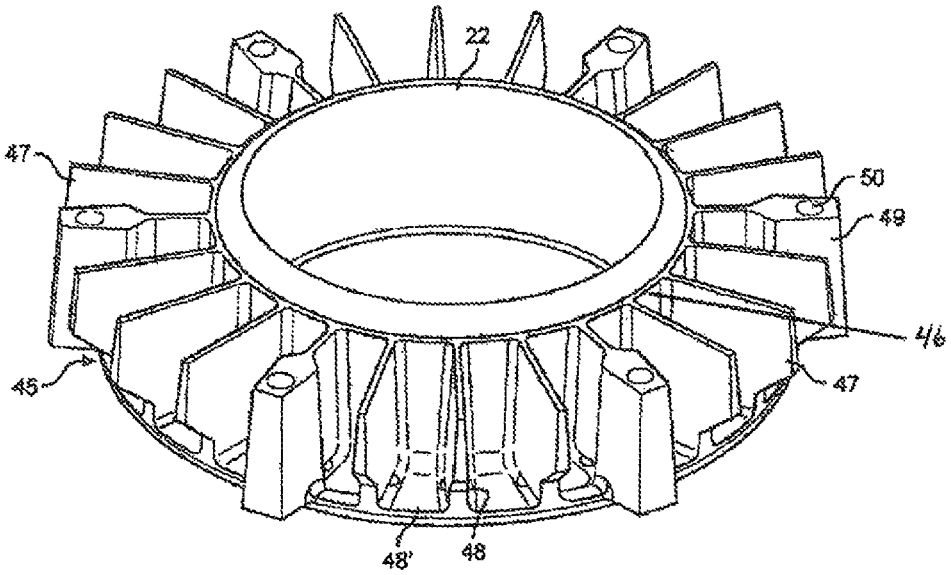
FIG. 5 is a perspective view of a heat sink casting in accordance with the invention.
Figure 6:
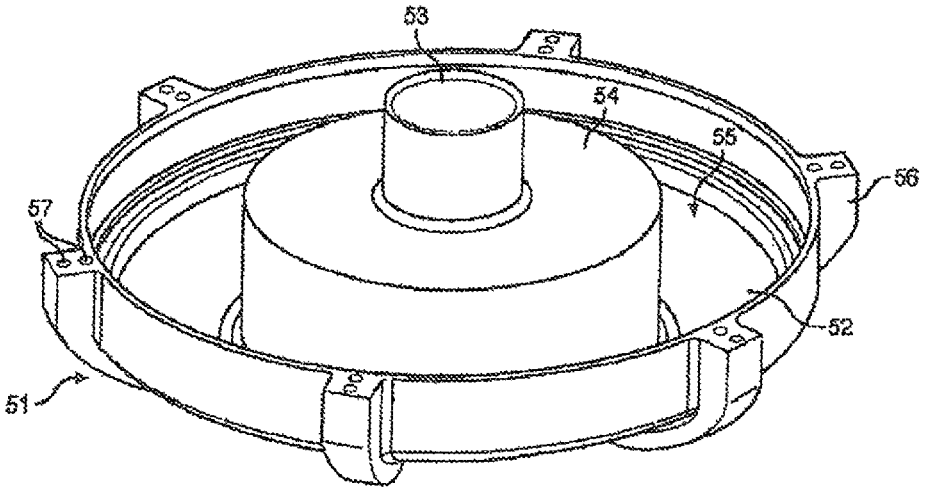
FIG. 6 is a perspective view of a pedestal casting of the invention.
Figure 10:
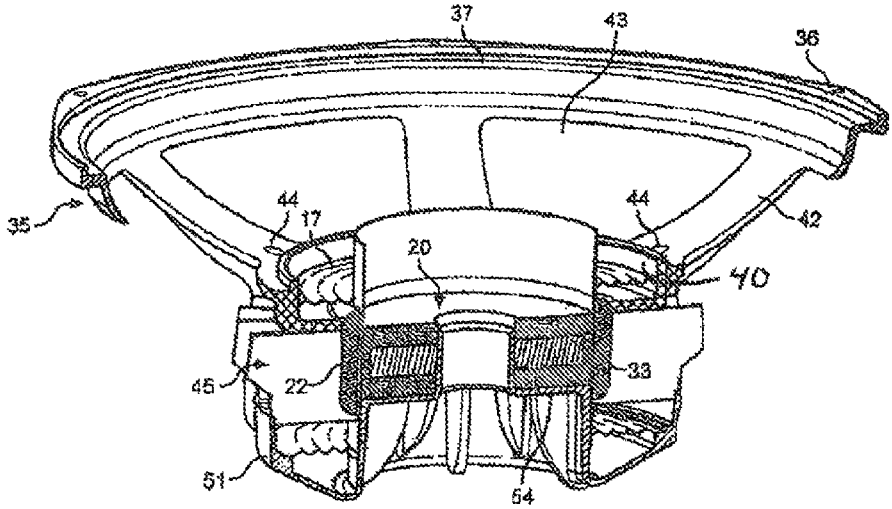
FIG. 10 is a view showing the assembly of the basket casting to the assembly of FIG. 9.

With reference FIGS. 4-6, the transducers of the invention utilize three non ferrous castings, preferably of aluminum, to support and position the components of the magnetic circuit. It should be noted that the term "castings" is not intended to be limited to an article formed by a casting process but rather articles that are formed to create "frame structures" for purposes of support other articles. Thus, in this application, the castings are frame-like structures. The first or outer casting is shown in FIG. 4 and is a frame or basket casting 35 in which the speaker cone 15 will be supported. The casting 35 includes an outer outwardly extending annular flange 36 that is designed to be secured to a support surface within a speaker box or housing, not shown, and an outer inwardly extending annular lip 37 to which an upper reinforced edge 38 of the cone is secured by an annular spider suspension member 39, see FIG. 1. The casting 35 also has an inner annular hub 40 inside which an outer edge of the outer spider suspension member 17 is connected. The outer flanges are connected to the inner hub by a plurality of arcuate arms 42 that are spaced from one another to create large air gaps 43 there between. Openings 44, see FIG. 10, are provided through the base of the arms for purposes of receiving bolts to secure the casting 35 to the other castings.

A second of the castings is shown in FIG. 5 is a heat sink casting 45 which includes an inner annular hub 46 from which extend a plurality of fins 47 having air vent holes 48 through a bottom ring portion 48' thereof such that air passing therethrough will pass along the fins. As shown, the vent holes may be aligned at the base of the fins. The fins are used to create additional area in contact with the outside air to improve heat dissipation. A plurality of lugs 49 have holes 50 therethrough for receiving the bolts for uniting the castings together.

The third casting is shown in FIG. 6 and is an annular pedestal casting 51 having a circular recess 52 in which the inner spider suspension member 16 is positioned, a raised and concentric magnetic sub assembly support hub 54 and an inner annular alignment cylinder 53 for aligning and stabilizing the magnetic sub assembly relative to the pedestal casting. An annular raised seat 55 is provided within the recess 52 for purposes of facilitating the attachment of the inner spider suspension member 16 as will be described below. A plurality of lugs 56 extend from the outer edge of the casting and include pairs of openings 57 for receiving the bolts to secure the three castings together.

The method of assembly of the transducer of the present invention includes the steps of initially placing the ferromagnetic outer ring 22 within the hub 46 of the heat sink casting and securing the outer ring in place by adhesive, as shown in FIG. 5. The magnetic sub assembly 20 is mounted to the pedestal casting 51 with the south or rear pole plate 34 in flat engagement with the support hub 54, as shown in FIG. 7. At this point, the inner or rear spider suspension member 16 is secured to the coil 11 with adhesive. Thereafter, the voice coil with the attached inner spider are placed in surrounding relationship with respect to the magnetic sub assembly and within the recess 52 of the pedestal casting and the outer portion of the inner spider 16 is adhesively secured in place, see FIG. 8.

Shims, not shown, are used to maintain a clearance between the voice coil and the magnetic sub assembly during this process.

Figure 8:
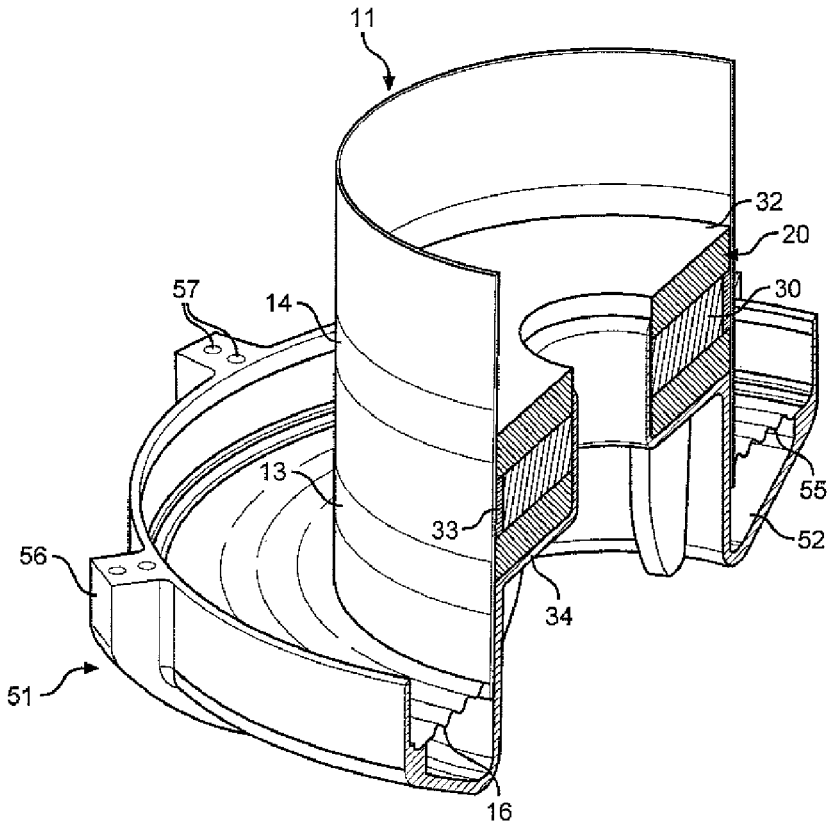
FIG. 8 is a view showing the assembly of the voice coil about the magnetic sub assembly.
Figure 9:
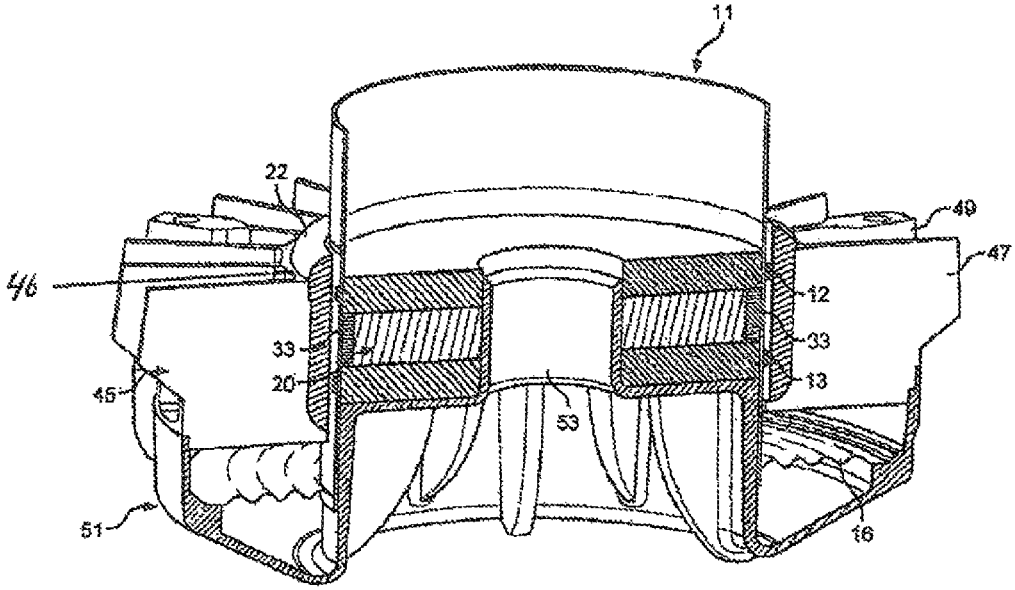
FIG. 9 is a view showing the assembly of the heat sink casting to the assembly of FIG. 8.

The assembly shown in FIG. 8 is subsequently placed on a bottom platform of a heavy duty press so that it does not move. The heat sink casting 45, fitted with the outer ring 22, is mounted on a press arm that is accurately aligned above the bottom platform of the press. The press arm is lowered precisely to place the heat sink casting in surrounding relationship to the magnetic sub assembly and the two castings are compression fitted and bolted together, as shown in FIG. 9. During this process, there can be no lateral movement of components or the fragile voice coil could be damaged. As the magnetic sub assembly has already been magnetized, a tremendous magnetic force is established between the outer ring 22 and the magnetic sub assembly as they approach one another. Such a force for a large driver cannot be overcome manually, thus requiring the mechanical assembly set forth. Various mechanical, hydraulic or pneumatic press devices may be used.

Figure 11:
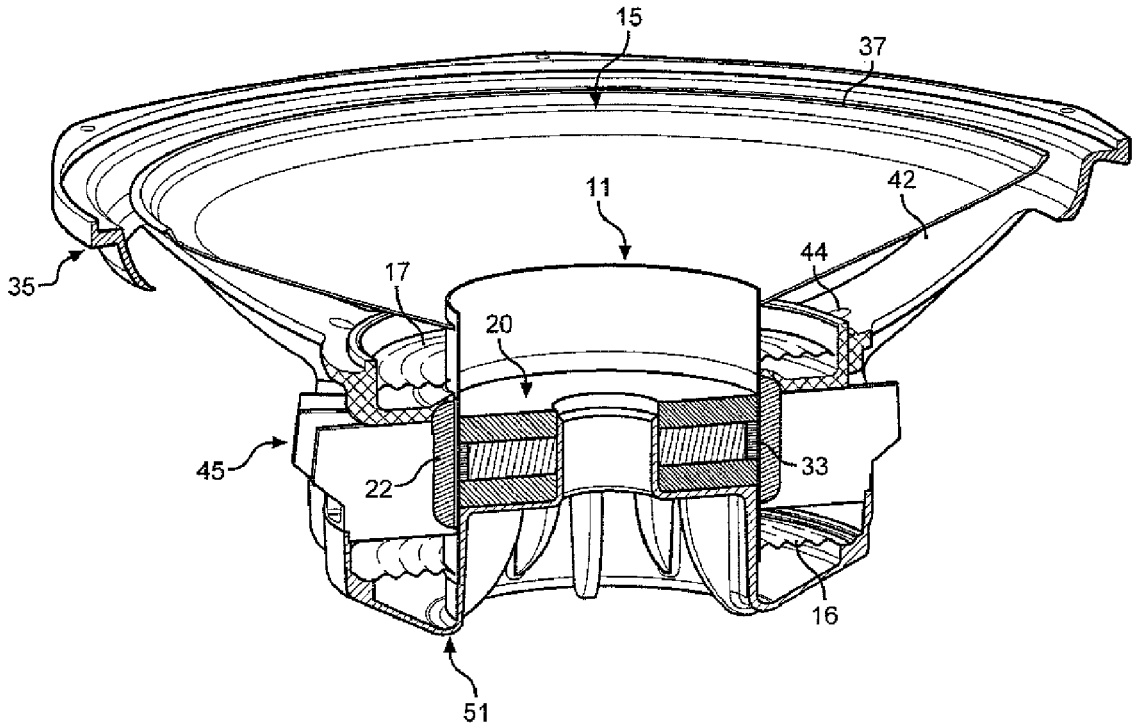
FIG. 11 is a view showing the mounting of the transducer cone to the voice coil cylinder and basket frame.
Figure 12:
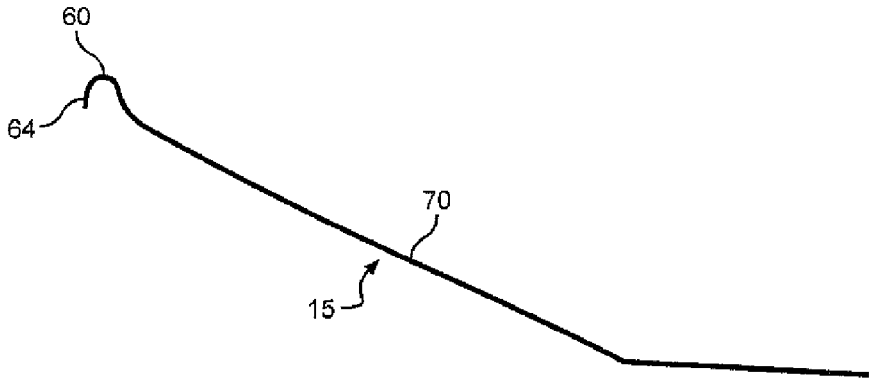
FIG. 12 is a profile section of the cone of FIG. 11.

Thereafter, the frame or basket casting 35 is bolted to the other castings. The outer spider suspension member 17 is secured by adhesive between an upper outer portion of the coil cylinder 14 and the surrounding hub 40 of the casting 35 as shown in FIG. 10. With reference to FIGS. 11 and 12, the cone is then installed by adhering an upper reinforced annular rim 60 of the cone 15 to the spider suspension member 39 (shown in FIG. 1) and the member 39 within the casting 35. An inner annular edge 62 of the cone 15 is also adhered adjacent the outer edge of the coil cylinder, as also shown in FIG. 1.

As previously described, the air vent holes in the heat sink casting are provided so that they are located between the two spider suspension members 16 and 17. The massive axial movement of the motor of the invention allows the spiders 16 and 17 to create airflow or turbulence through the vent holes as the voice coil is driven. The air flows in and out through the vent holes and across the fins, thereby facilitating heat exchange. Therefore, the heat sink features of the invention use fins to increase surface area to promote heat exchange and the air venting system dissipates heat more quickly from the voice coil and outwardly across the fins at a greater rate.

The last step in the assembly is the wiring, soldering and installation of the dust cap 65 to prevent particles from entering into the air gap.

Due to the size and power requirements of the cones of the present invention, novel cone design features were incorporated into the final cone configurations and material. To provide sufficient stiffness for diameters as great as 21 inches, the cones of the invention are molded from impregnated composite materials. With specific reference to FIG. 12, each cone is molded into a shallow and very slightly concave outer surface profile 70, similar to an upside down sauce pan lid. The outer edge or rim 60 of the cones is strengthened by providing an upturned configuration that terminates in an edge return portion or lip 64, as shown.

Figure 13:
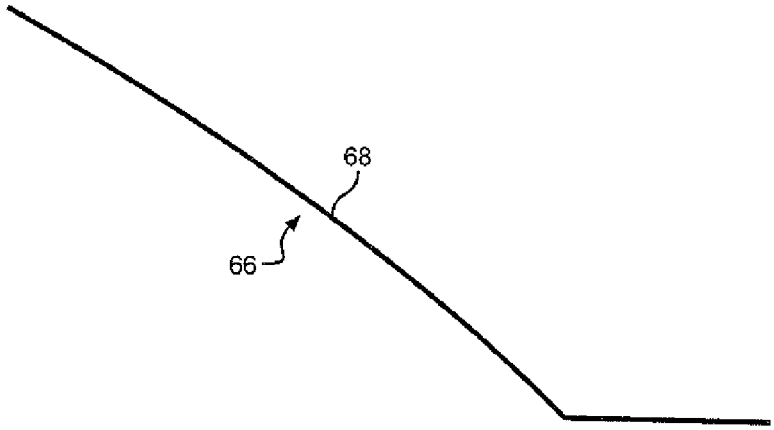
FIG. 13 PRIOR ART
FIG. 13 is a profile view of a conventional paper cone.
Figure 14:
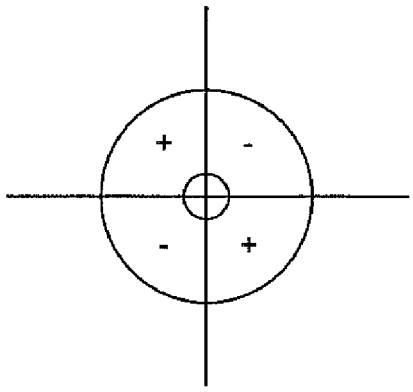
FIG. 14 is a overhead view of a conventional cone showing the modal resonant behavior when being driven.

A conventional cone profile 66 is shown in FIG. 13 and includes a generally convex outer surface 68. Conventional paper speaker cones do not feature a concave shallow profile as taught by the present cone configuration nor do they include an upturned edge and an edge return, as shown in FIG. 12 with respect to the present invention. The conventional profile is generally steep towards the center and flattens out toward the edge. The steep center is necessary to give the cone the axial rigidity needed. With reference to FIG. 14, an overhead view of a cone is shown divided into four sections. During operation of a conventional speaker cone, when a coil moves forward to stimulate at least a portion of the cone to move forward, as shown at "+", a radial section of the cone simultaneously moves in the opposite or "−" (rear) direction. These radial resonant modes are not controlled by the piston and it is also possible to develop non-radial vibration modes.

With the shallow concave geometry of the present invention and the upturned edge, a first radial mode is removed out of the transducers operating frequency range. The back folded rim also stiffens the edge and removes the non-radial modes from the drivers operating frequency range. This action cannot be achieved using conventional paper drivers. The configuration or profile of the drivers or cones of the invention when molded from an impregnated composite permit the operation of the large drivers at the power levels set forth herein. One preferred material for the drivers is KEVLAR™ (para-aramid fibers).

One example of driver in accordance with the invention is a 21 inch dual coil, dual spider driver. It has a KEVLAR™ material cone with 6 inch coil and a neodymium magnet. The driver can operate at up to thirty five hundred watts and resists nominally at two Ohms. It travels 26 mm in end to end motion.

As described, the subwoofers of the present invention are designed to handle four to six times the power of most conventional subwoofers used in large scale sound systems.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. An acoustic transducer comprising:

a magnetized permanent magnet subassembly supported by a third non ferrous frame structure;

a ferromagnetic cylinder seated within and affixed to a second non ferrous frame structure, the second non ferrous frame structure being configured for heat dissipation such that the ferromagnetic cylinder and the second non ferrous frame structure are in a thermally conducting heat dissipation relationship, the second non ferrous frame structure being bolted to the third non ferrous frame structure to provide an annular gap between the ferromagnetic cylinder and the magnetized permanent magnet subassembly, said third non ferrous frame structure including a self alignment feature for aligning and stabilizing the magnetized permanent magnet subassembly relative to the third non ferrous frame structure;

a voice coil cylinder carrying at least one two conductive winding windings, a first of said at least two conductive windings being spaced from a first end of said voice coil cylinder, and a second of said at least two conductive windings being spaced from a second end of the voice coil cylinder, the voice coil cylinder supported within the annular gap by an inner a first suspension member attached to one of said opposite ends which is associated with also attached to the third non ferrous frame structure and an outer a second suspension member attached to the other of said opposite ends which is also attached to a non ferrous frame structure other than the third non ferrous frame structure so that said voice coil cylinder encases all permanent magnetic material of the acoustic transducer; and a mechanically supported sound producing cone connected to the voice coil cylinder.

2. The acoustic transducer of claim 1, wherein the sound producing cone is supported with a cone suspension member.

3. The acoustic transducer of claim 2, wherein the cone suspension member is associated with a first non ferrous frame structure.

4. The acoustic transducer of claim 1, wherein the frame structures are castings.

5. The acoustic transducer of claim 4, wherein the castings are aluminum castings.

6. The acoustic transducer of claim 1, wherein the annular gap is approximately 0.070 inches across.

7. The acoustic transducer of claim 3, wherein the first frame structure comprises a basket configuration.

8. The acoustic transducer of claim 1, wherein the second frame structure configured for heat dissipation comprises a heat sink for dissipating heat from the ferromagnetic cylinder.

9. The acoustic transducer of claim 8, wherein the heat sink comprises a plurality of fins.

10. The acoustic transducer of claim 9, wherein the heat sink comprises a plurality of vent holes therethrough for directing air moved by the sound producing cone along the fins during operation of the acoustic transducer.

11. The acoustic transducer of claim 1, wherein the permanent magnetic subassembly includes a permanent magnet formed of neodymium.

12. The acoustic transducer of claim 1, wherein the sound producing cone is formed of KEVLAR™.

13. The acoustic transducer of claim 1, wherein the non-ferrous metal material is aluminum.

14. The acoustic transducer of claim 1, wherein said second and third non ferrous frame structures include a plurality of lugs spaced around a circumference of each of said second and third non ferrous frame structures, and wherein each lug of said third non ferrous frame structure has a hole therethrough and being in registration with a hole in a corresponding lug in said second non ferrous frame structure, and wherein bolts are located in the second and third non ferrous frame structures to bolt them together.

15. The acoustic transducer of claim 1, wherein said magnetized permanent magnet subassembly is generally ring shaped having a generally central opening and wherein said third non ferrous frame structure has a raised support hub on which said ring shaped magnetic subassembly rests, and wherein said alignment features of said third non ferrous frame structure includes said third non ferrous frame structure having an inner alignment cylinder extending from said raised support hub such that said inner alignment hub extends through said central opening in said magnetized permanent magnet.

16. A method of assembling an acoustic transducer, comprising:

supporting an already magnetized permanent magnet subassembly by a third non ferrous frame structure;

connecting an inner first suspension member for a voice coil cylinder to the third non ferrous frame structure, said voice coil cylinder carrying two conductive windings spaced adjacent opposite ends of the voice coil cylinder;

affixing a ferromagnetic cylinder to a second non ferrous frame structure;

aligning and stabilizing the already magnetized permanent magnet subassembly on the third non ferrous frame structure using self alignment features on said third non ferrous frame structures, bolting the second non ferrous frame structure associated with the ferromagnetic cylinder to the third non ferrous frame structure to provide for the voice coil cylinder an annular gap between the ferromagnetic cylinder and the already magnetized permanent magnet subassembly, the second non ferrous frame structure being configured for heat dissipation such that the ferromagnetic cylinder and the second non ferrous frame structure are in a thermally conducting heat dissipation relationship, said already magnetized permanent magnet subassembly and said ferromagnetic cylinder being positioned such that said voice coil cylinder encases all permanent magnetic material of the acoustic transducer;

connecting a second suspension member for the voice coil cylinder to a non ferrous frame structure other than the third non ferrous frame structure;

connecting a sound producing cone to the voice coil; and mechanically supporting the sound producing cone.

17. The method of claim 16, wherein the step of supporting the sound producing cone comprises bolting a first non ferrous frame structure to at least one of the third and second non ferrous frame structure and supporting the sound producing cone with the first non ferrous frame structure.

18. The method of claim 16, further comprising securing a dust cap over an outer opening in the voice coil cylinder.

19. The method of claim 16, wherein the step of connecting an inner suspension member for a voice coil cylinder to the first non ferrous frame structure is executed prior to the step of bolting the second non ferrous frame structure to the first non ferrous frame structure.

20. The method of claim 19, wherein the step of bolting a second non ferrous frame structure to the third non ferrous frame structure is executed prior to the step of connecting an outer suspension member for the voice coil cylinder to a non ferrous frame structure other than the third non ferrous frame structure.

21. An acoustic transducer comprising:

a third support frame component including a pedestal portion and a first suspension member, said first support frame component being made from a non ferrous material;

a magnetized permanent magnet subassembly including a permanent magnet located between front and rear plates, said magnetized permanent magnet subassembly being seated on said pedestal portion of said third support frame component so that said rear plate rests on said pedestal portion;

a second support frame component configured for dissipating heat from the transducer, said second support frame component including a rear end, an opposing front end, and a non ferrous heat sink surrounding a ferromagnetic cylinder with the ferromagnetic cylinder and the non ferrous heat sink being in a thermally conducting heat dissipation relationship, said rear end of said second support frame component being bolted to said third support frame component so that said ferromagnetic cylinder encases said magnetized permanent magnet assembly at a spaced distance therefrom to create an annular gap between said magnetized permanent magnet assembly and said ferromagnetic cylinder;

a first support frame component supporting a second suspension member, said first support frame component being bolted to said front end of said second support frame component; and a voice coil cylinder including a rear end, an opposing front end, and two spaced conductive windings, a first of said two conductive windings being spaced from said front end of said voice coil cylinder, and a second of said two conductive windings being spaced from said rear end of said voice coil cylinder, said voice coil cylinder being received within said annular gap between said magnetic assembly of said third support frame component and said ferromagnetic cylinder of said second component so that said conductive windings of said voice coil cylinder are positioned between said magnetized permanent magnet subassembly and said ferromagnetic cylinder, said rear end of said voice coil cylinder being secured to said first suspension member of said third support frame component and said front end of said voice coil cylinder being secured to said second suspension member of said third component; and said third support frame component including self alignment features for aligning and stabilizing the magnetized permanent magnet subassembly relative to the third support frame component.

22. The acoustic transducer of claim 21, wherein said third support frame component is removeably attached to said second support frame component.

23. The acoustic transducer of claim 21, including a mechanically supported sound producing cone connected to the voice coil cylinder, wherein the sound producing cone is supported with a non ferrous cone suspension member.

* * * * *